US005511616A

United States Patent [19]

Bert

[11] Patent Number: 5,511,616

[45] Date of Patent: Apr. 30, 1996

[54] HYDROCARBON RECOVERY METHOD USING INVERTED PRODUCTION WELLS

[75] Inventor: David R. Bert, Bakersfield, Calif.

[73] Assignee: Mobil Oil Corporation, Fairfax, Va.

[21] Appl. No.: 376,255

[22] Filed: Jan. 23, 1995

[51] Int. Cl.[6] ..... E21B 7/06; E21B 36/00; E21B 43/24

[52] U.S. Cl. ..... 166/272; 166/50; 166/303; 166/306; 166/89.1

[58] Field of Search ..... 166/50, 272, 303, 166/306; 175/61, 62

[56] References Cited

U.S. PATENT DOCUMENTS

| | | | |
|---|---|---|---|
| 3,986,557 | 10/1976 | Striegler et al. | 166/50 X |
| 4,368,781 | 1/1983 | Anderson | 166/252 |
| 4,386,665 | 6/1983 | Dellinger | 166/50 X |
| 4,445,574 | 5/1984 | Vann | 166/50 X |
| 4,460,044 | 7/1984 | Porter | 166/50 X |
| 4,508,172 | 4/1985 | Mims et al. | 166/303 |
| 4,519,463 | 5/1985 | Schuh | 166/50 X |
| 4,598,770 | 7/1986 | Shu et al. | 166/50 X |
| 4,640,359 | 2/1987 | Livesey et al. | 166/276 |
| 4,682,652 | 7/1987 | Huang et al. | 166/50 X |
| 5,339,904 | 8/1994 | Jennings, Jr. et al. | 166/50 X |

*Primary Examiner*—Stephen J. Novosad
*Attorney, Agent, or Firm*—Alexander J. McKillop; George W. Hager, Jr.

[57] ABSTRACT

A method using an "inverted" production well for recovering hydrocarbons from a subterranean reservoir wherein the production wellbore has a substantially vertical, non-inverted portion with angle building to near 90°; an integral, substantially horizontal portion which extends into said reservoir; and an integral, upwardly curving tail portion which terminates near the top of the reservoir. A string of production tubing which may include a downhole pump is positioned within the non-inverted portion of wellbore. The inverted well increases the production interval within the reservoir and reduces bottom-water coning. Further, a plug can be set in the tail portion to reduce the production of steam through the wellbore. In another embodiment of the present invention, a single inverted well may be used both for injecting steam and producing fluids by extending a string of injection tubing through or adjacent to the production tubing and into the tail portion of the wellbore.

18 Claims, 3 Drawing Sheets

HYDROCARBON RECOVERY METHOD USING INVERTED PRODUCTION WELLS

TECHNICAL FIELD

The present invention relates to a method for recovering hydrocarbons from a subterranean reservoir through an inverted production well and in one of its aspects relates to a method for recovering hydrocarbons using an inverted production well(s) which has a non-inverted (e.g. vertical with angle building to near 90°) portion, a substantially horizontal portion wellbore which extends into the reservoir, and a tail portion which curves upwardly towards the surface to terminate at or near the top of the reservoir.

BACKGROUND

As is well known, thermal secondary recovery operations are routinely employed to recover heavy hydrocarbons, e.g. heavy oil, from subterranean reservoirs (e.g. oil sands). Due to its high viscosity, the heavy oil must be heated in place to reduce its viscosity so it will flow from the reservoir. Probably the most common of such thermal recovery operations involves "steam stimulation" wherein the heavy oil is heated in place by steam which is injected into the reservoir. A steam stimulation or steamflood process can be carried out by either (a) injecting the steam into an injection well and then producing the hydrocarbons from a separate well or (b) injecting the steam and then producing the fluids through the same well.

In a typical, conventional gravity-dominated steamflood recovery operation, steam is injected into one well while formation fluids (e.g. oil) are produced through spaced production wells. These production wells normally have substantially vertical wellbores which are cased to at least a depth which lies adjacent the top of the oil sand. The lower end of the wellbore is then completed with a gravel pack or the like through the production interval.

Steam is injected through the injector well for an initial period (e.g. 3 to 24 months) in order to establish thermal communication between the injector well and the production wells. During this initial injection period, each production well may either produce cold oil at a low flow rate or be stimulated by cyclically injecting steam into the producing well, itself. Higher production flow rates normally occur only after thermal communication between wells has been established.

In a steam stimulation operation such as described above, steam is injected down the injection well and out into the formation. Due to its relative density, the steam tends to rise towards the top of the formation during injection. This natural gravity segregation results in the creation of a "steam chest" across the top of the producing formation which, in turn, results in early steam breakthrough and less than 100% vertical sweep of steam through the formation.

This is especially true where a production well is completed at the top of an oil sand where steam, upon breakthrough, will be produced into the wellbore and up through the annulus of the producing well. This results in a substantial loss of valuable steam and at the same time, may create severe back pressure and pump problems which seriously inhibit the production of oil from the reservoir.

In steamfloods of this type, it has been observed that high oil production rates usually occur within a 1 to 3 month period just prior to steam breakthrough at a production well. In an effort to delay steam breakthrough and thereby contain the steam within the reservoir for a longer period, the production wells are often cased to an extended depth lying well within the reservoir thereby isolating the upper portion of the reservoir behind the casing. While delaying steam breakthrough, unfortunately, the extended casing may also delay the production of hot oil since the steam chest will now be located a significant vertical distance above any openings in the casings and/or liner thereby allowing only cold oil to enter the well.

Other techniques have been proposed for improving the production of heavy oil from a reservoir by improving the sweep efficiency of the injected steam through the reservoir. One such technique involves the injection of a foam or other flow-blocking material into a formation to fill previous swept and/or more permeable zones of the reservoir before injecting the steam. Another technique involves the drilling of horizontal wells into the reservoir to intersect natural fracture systems of the reservoir and to provide a long completion interval within the reservoir. The present invention provides still another method for producing heavy hydrocarbons from a reservoir which use "inverted" production wells which, in turn, provide several apparent advantages over either vertical or horizontal production wells.

SUMMARY OF THE INVENTION

The present invention provides a method using an "inverted" production well for recovering hydrocarbons from a subterranean reservoir. The production well of the present invention is "inverted" in that at least the terminal portion thereof is inverted, i.e. the terminal end curves upward towards the surface. More specifically, the inverted wellbore of the present invention has a substantially vertical (with angle building to near 90°), non-inverted portion which extends from the surface to a depth substantially adjacent the top of said reservoir; an integral, substantially horizontal portion which extends into said reservoir; and an integral, upwardly curving tail portion which terminates near the top of the reservoir.

Typically, the production well is cased approximately throughout the substantially vertical, non-inverted portion of the wellbore with the remaining wellbore being completed in accordance with known completion procedures (e.g. cased and perforated, open-hole completions, gravel-packed, etc.). A string of production tubing which may include a downhole pump ( not shown ) on the lower end thereof is positioned in the wellbore and preferably terminates within the non-inverted portion of wellbore. However, as should be recognized, the tubing/pump inlet can be repositioned within the wellbore during the life of the production well in response to the actual production of the well.

The inverted production well of the present invention can be used in different types of steamflood recovery operations. For example, a plurality of inverted production wells may be spaced from a central steam injector well in conventional steamflood patterns, e.g. five-spot, nine-spot, in-line, etc. Steam, when injected through the injector well, will migrate upward to form a "steam chest" across the reservoir. Preferably, in such patterns, the tail portion of each inverted wellbore is deviated towards the injector well and each terminates at or near the top of the reservoir so it will lie in or near the steam chest as it is formed.

The high-angle horizontal nature of the inverted wellbore of the present invention greatly enhances the length of the completed production interval within the reservoir and can substantially reduce the bottom-water coning within the formation. Further, since the tail or terminus of the wellbore is located near the top of the reservoir (i.e. in or near the steam chest) and since the intake of the production tubing and pump (if used) is located in the non-inverted portion of the well, hot oil and water from the formation are forced to flow from the tail of the wellbore downward through the entire completed length of the wellbore before the heated fluids reach the tubing/pump inlet. These hot fluids provide good conductive heating along this interval thereby enhancing oil production in what would otherwise be a cold interval.

Further, because the steam is entering at the tail of the wellbore and condensing, it will be produced as hot water through the tubing/pump inlet instead of being produced through the well annulus as would be the case in prior art systems thereby substantially eliminating any significant back pressure against the reservoir which, in turn, would inhibit oil production. Further, the production of steam through the tail portion can be reduced, if necessary, by setting a bridge plug or the like within the tail portion of the wellbore to block the downward flow of steam through the tail portion. This plug or additional plugs can be repositioned during the life of the production well to compensate for increasing production of steam into the tail portion of the wellbore.

In another embodiment of the present invention, a single inverted well may be used both as the steam injector well and the production well of a steamflood by positioning a string of injection tubing within the wellbore and extending the injection tubing into the tail portion of the wellbore. The injection tubing can be run through the production tubing or it can be run along side the production tubing. Steam is injected through the injection tubing into the tail portion of the wellbore to heat the oil in the top of the reservoir so that it may flow into the lower wellbore to then be produced through the production tubing.

BRIEF DESCRIPTION OF THE DRAWINGS

The actual operation and apparent advantages of the present invention will be better understood by referring to the drawings in which like numerals identify like parts and in which.

BEST KNOWN MODE FOR CARRYING OUT INVENTION

There are substantial reservoirs of heavy hydrocarbons (hereinafter collectively called "heavy oil") throughout the world which have such a high viscosity that they can not be economically produced by primary recovery techniques. To produce these reservoirs, it is common to use thermal techniques which heat the heavy oil in place to reduce its viscosity to a level sufficient to allow it to flow from the reservoir into a production well. One of the best known and most commonly used of such thermal processes is commonly referred to as "steam stimulation" and one which involves injecting steam down the well and into the reservoir to heat the heavy oil.

Figure 1:
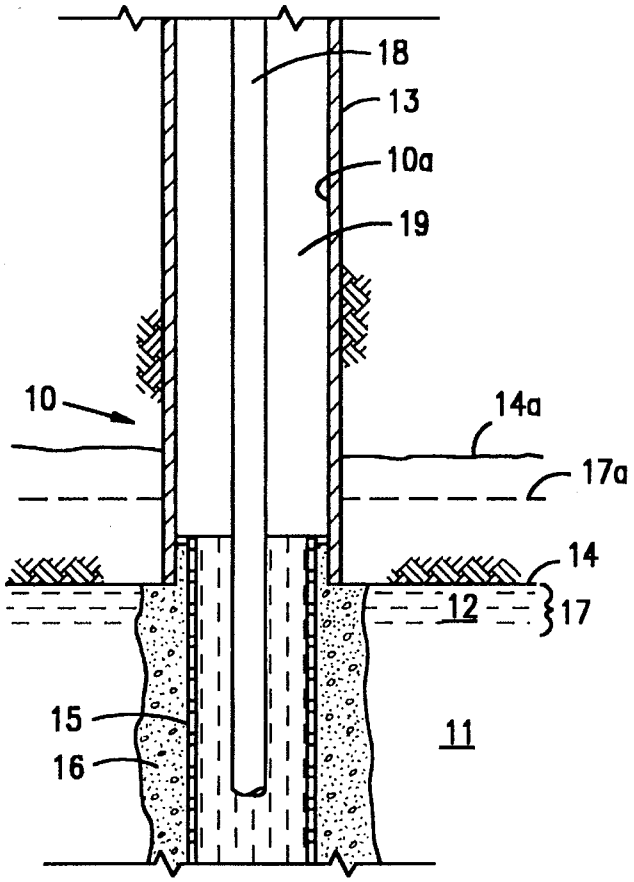
FIG. 1 (PRIOR ART)
FIG. 1 is an elevational, sectional view of the lower end of a production well of a steamflood recovery operation which has been completed in accordance with known, prior art techniques.

In typical, prior art steam stimulation processes (FIG. 1), steam 12 is injected down an injection well (not shown) and out into the production formation or reservoir (i.e. oil sand 11) towards a production well 10 (FIG.1). As illustrated, well 10*a* has a substantially vertical wellbore which has been cased (casing 13) and cemented (not shown) to a depth approximately adjacent the top 14 of the oil sand. The lower portion of wellbore 10*a* is "gravel-packed" adjacent the production interval of oil sand 11 (i.e. completed with a slotted liner 15 which, in turn, is surrounded by a pack of gravel 16). A production tubing 18 which may have a downhole pump (not shown) on its lower end extends into the wellbore through which the formation fluids are produced to the surface.

Since steam 12 is substantially in the vapor phase, its density is substantially less than that of either the heavy oil or the formation water which causes the steam to rise towards the top of the reservoir as it radiates outward from the well. This natural gravity segregation of steam in a typical heavy oil reservoir routinely results the establishment of a "steam chest"17 which blankets the top of oil sand 11. This, in turn, almost always results in an early steam breakthrough at wellbore 10 with a less than 100% vertical sweep of steam through the formation.

Once breakthrough occurs, steam is produced up well annulus 19 resulting in a substantial loss of heat input to the reservoir. Also, this early breakthrough normally creates a back pressure against the reservoir which may retard oil production and can lead to severe downhole pump problems.

In an attempt to counteract early steam breakthrough in the prior art production wells such as vertical wellbore 10, the wellbore is sometimes cased to a lower depth (i.e. some distance into oil sand 11 ). As illustrated in FIG. 1, the top of oil sand 11 would now lie at 14*a*. This isolates the upper portion of the oil sand lying behind the additional casing from the wellbore. While this configuration will normally delay steam breakthrough, it is also likely to delay hot oil production since the horizontal steam interface (dotted line 17*a*) will now lie a significant vertical distance above any perforations in casing 13 and/or the openings in liner 15 thereby allowing only cold oil to be produced from the oil sand.

Figure 4:
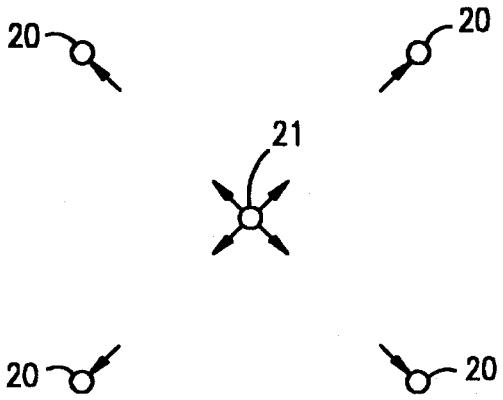
FIG. 4 is a plan view of a typical steamflood pattern in which the present invention can be used.
Figure 2:
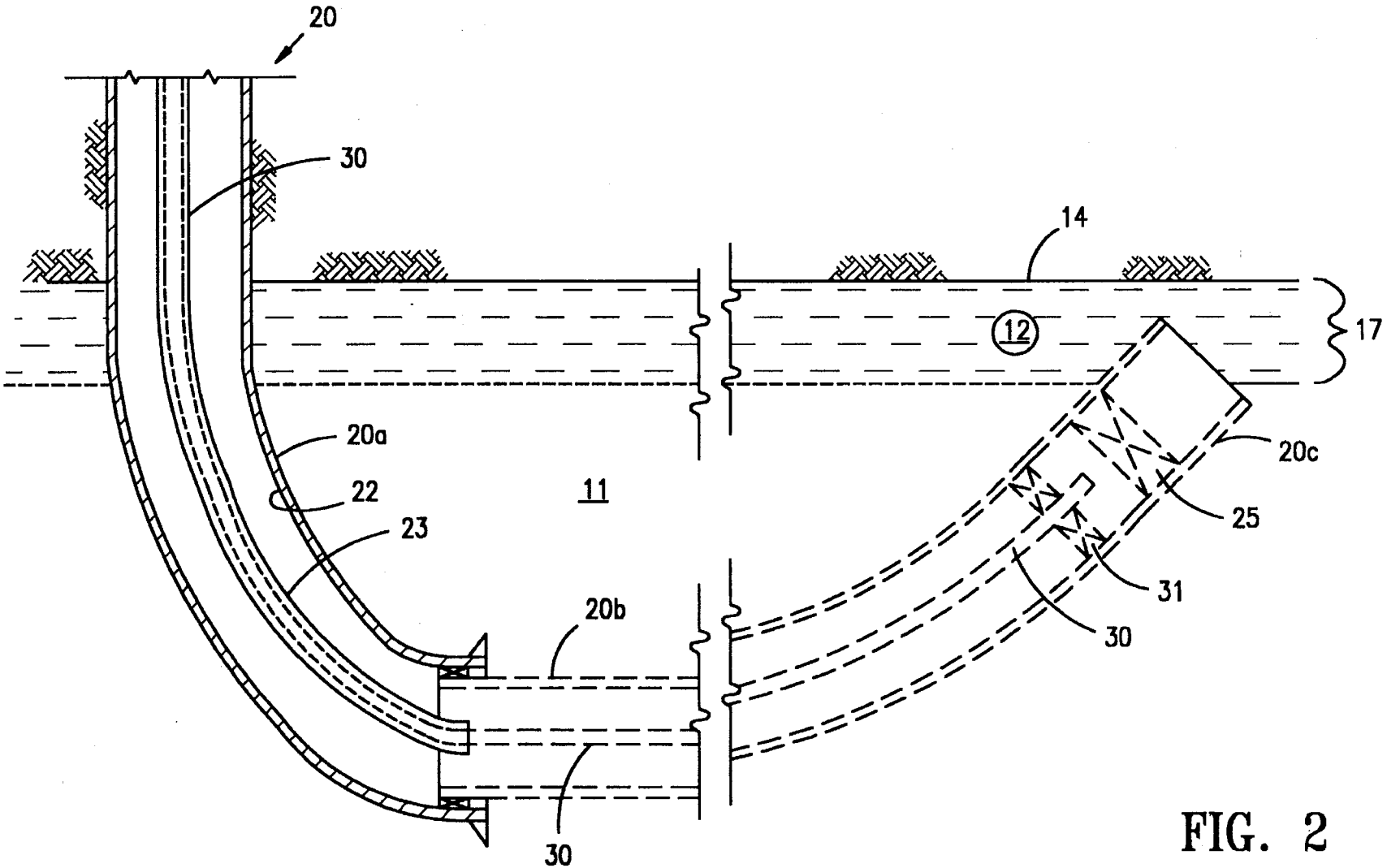
FIG. 2 is an elevational, sectional view of the lower end of an inverted production well which has been completed in accordance with the present invention.
Figure 3:
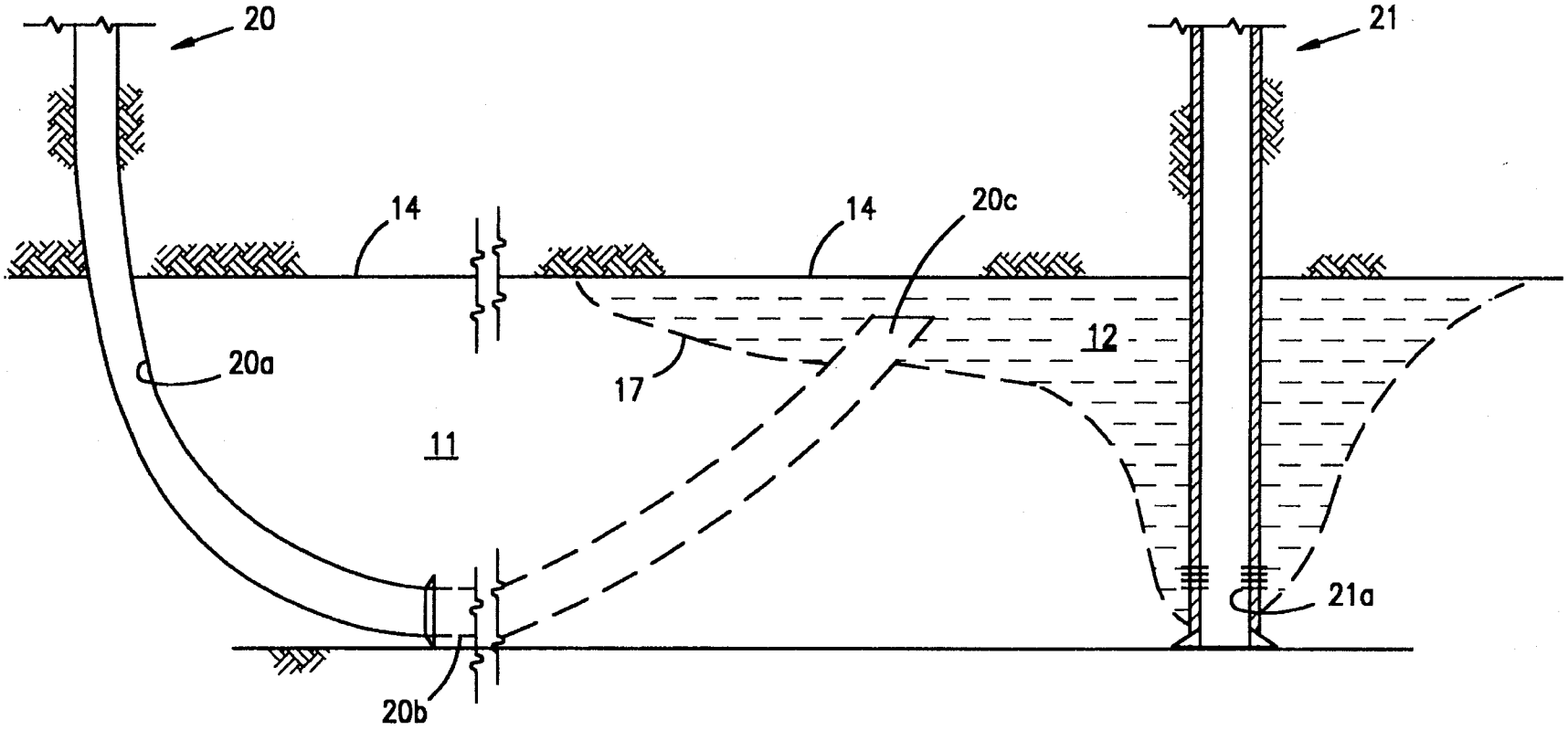
FIG. 3 is an elevational, sectional view of the lower end of an inverted production well which has been completed in accordance with the present invention and the lower end of an associated, spaced steam injection well.

Referring now to FIGS. 2–4, the present invention will now be fully described. In accordance with the present invention, the production well 20 is an "inverted" well in that at least the terminal or tail end of the wellbore is inverted. As used throughout the present specification and claims, "inverted well" or "inverted wellbore" is meant to refer to and describe a wellbore which curves or deviates from the vertical towards a horizontal direction and then curves upwardly towards the surface (i.e. "inverted") as the wellbore is being drilled into said reservoir.

As best seen from in FIG. 2 (not to scale), inverted wellbore 20 curves outward from the substantially vertical, non-inverted portion 20*a* towards the horizontal (e.g. 20*b*) as it passes into reservoir 11 and preferably continues through a horizontal portion 20*b* (length of portion 20*b* depending on a particular reservoir) near the bottom of reservoir 11 before the wellbore begins to curve upward towards the surface.

The wellbore continues upward to form a tail portion 20*c* which terminates near the top 14 of reservoir or oil sand 11. As will be understood by those skilled in the art, the drilling of such wells are well within the present state-of-the art and can be drilled with presently commercially-available equipment (e.g. whipstocks, downhole motors, bent subs, etc.).

Typically, production well 20 is cased (i.e. casing 2) and cemented (not shown) substantially through the non-inverted portion 20a of the wellbore. The remaining wellbore (i.e. 20*b*, 20*c*) which will form the production interval of the well is then completed in accordance with an appropriate, known completion technique (e.g. cased and perforated, open-hole completions, gravel-packed, etc.). A string of production tubing 23 which may carry a downhole pump (not shown) on its lower end is lowered into the wellbore with its inlet (i.e. lower end) being positioned at or near the lower end of the non-inverted portion of wellbore 20 (i.e within the substantially vertical or horizontal portion of the well).

The present inverted production well can be used in a variety of different types of steamflood recovery operations. One such operation is shown in FIG. 3 (not to scale) wherein inverted production well 20 is one of a plurality of production wells which are spaced from a steam injector well 21. The production wells 20 may be positioned around a central injection well 21 in a typical 5-spot pattern (FIG. 4) or they may be arranged in other well known steamflood patterns (e.g. nine-spot, in-line, etc.) with similar success.

As illustrated, inverted wellbore 20 is preferably deviated inwardly towards injector well 21 with tail portion 20*c* terminating at or near the top 14 of reservoir 11. Steam 12 is injected through perforations 21*a* in well 21 and will migrate upward to form steam chest 17 across the top of the formation in the same manner as in prior steamfloods. As will be fully discussed below, the inversion of wellbore 20 so that it terminates near the top of the reservoir (i.e. in contact with steam chest 17) provides several advantages over production wells previously used in steamfloods.

For example, the high-angle horizontal nature of the inverted wellbore greatly enhances the length of the completed production interval within the reservoir and can substantially reduce bottom-water coning within the formation. Further since the tail or terminus of the wellbore is located near the top of the oil sand and in contact with steam chest 17 and since the intake of the production tubing 23 and pump (if used) is located in the non-inverted portion of the well, hot oil and water from the formation is forced to flow downward from the tail portion 20*c* of the wellbore and along the remaining completed interval of the wellbore before they reach the tubing/pump intake. These hot fluids provide conductive heating along this entire interval thereby enhancing oil production from what would otherwise be a cold interval of reservoir.

Another advantage arising from the present inverted well results from the fact that gravity will tend to keep the steam at the top of the reservoir (i.e. within steam chest 17) where the reservoir pressure is at its lowest. This will cause the higher-pressure reservoir fluids below the steam chest to be produced into the wellbore. Further, where gravity and pressure differences are not enough to keep steam from entering the wellbore, the steam will condense into a liquid as it mixes with the higher-pressure production fluids and will travel therewith towards the tubing and/or pump inlet in the non-inverted portion 20*a* of the wellbore.

Because the steam is entering at the tail 20*c* of the wellbore and condensing, the normal steam breakthrough phenomenon at a production well is changed. Steam is no longer creating back pressure against the reservoir which can seriously inhibit the production of oil therefrom. The condensed steam is produced as hot water through the tubing/pump inlet instead of being produced through the well annulus and an associated casing vapor recovery system (CVRS) which is commonly present on most prior art production wells which are used in typical steamfloods.

Further, the higher temperature of the produced fluids will reduce oil-treating costs at the surface by requiring (1) less fuel for heater-treaters and/or (2) less chemicals. The costs of processing the hot fluids through the flowline are much lower than processing steam vapors through a typical CVRS. Another disadvantage of producing steam through a conventional CVRS is that when steam breakthrough occurs at one production well, the overall CVRS pressure for all wells can increase thereby creating a back pressure (hence inhibit oil production) from all of the other production wells connected to the CVRS.

Referring again to FIG. 2, production of steam from steam chest 17 through tail portion 20*c* can be reduced, if necessary, by setting a bridge plug 25 or the like (FIG. 2) within the tail portion 20*c* at a point downstream of the steam chest 17 to block downward flow of steam from the tail portion 20*c* into the adjacent portions of the wellbore. In a conventional vertical well or a true horizontal well where the wellbore terminates at the bottom of the reservoir and the steam chest exists at the top, a bridge plug or the like can not be used without sealing off both the oil zone and the steam chest which is unacceptable.

Another advantage of using an inverted production well is that the entire completion interval within the wellbore is in contact with hot fluids substantially from the beginning of the steam injection. The hot fluids produced from the steam chest region of the wellbore allow heat to be transferred to the otherwise cold, near-wellbore lower reservoir region. The heat transfer from the hot produced fluid enhances oil production in what would otherwise be a cold lower wellbore interval.

Further, an inverted production wellbore allows the inlet of the production tubing/pump to be placed at different points in the wellbore during the production life of the well. For example, the inlet may be placed closer to steam chest region 17 if a large volume of oil is being produced exclusively from that zone. Likewise, the inlet may be placed higher up in the non-inverted portion of the wellbore to establish a fluid level in the wellbore which will inhibit excessive steam production from the steam chest 17. The actual position of the inlet of the tubing/pump will be dictated by the changing steamflood dynamics of the well, e.g. steam chest growth, water production, etc.

In another embodiment of the present invention, a single inverted well 20 may be used both as the steam injector well and the production well. As illustrated in FIG. 2, a string of injection tubing (shown in dotted lines 30) is run through the production tubing 23 and extends through the wellbore into tail portion 20*c*. It should be understood that the injection tubing 30 can alternately be ran along side production tubing 23 in the wellbore, if preferred. A packer 31 or the like is set to isolate an injection zone within tail portion 20*c* into which steam is to be injected. The steam heats the oil in reservoir 11 in the same manner as before with the heated fluids flowing downward into the wellbore below the injection zone where it is produced through production tubing 23. The injection of steam through the long tubing string 30 will further enhance the heating of the completed interval of the wellbore.

The use of inverted production wells can further enhance the steamflood economics by eliminating the lag time normally associated with waiting on thermal communication or response between vertical wells. When the inverted well is directed towards the injection well (FIG. 3), thermal communication in the lateral or horizontal plane is also accelerated significantly.

Further, the wellbore may be plugged back to shorten its length as the injected steam moves areally across the reservoir 11 so that the wellbore remains in contact with the steam chest in both the vertical and lateral or horizontal planes throughout the producing life of the well. This also places the edge of the completion interval in continuous contact with the leading edge of the steam chest. Still further, inverted wells should eliminate the need for cyclic steam, which is typically injected into the production wells of a steamflood during the first few years to stimulate production.

An added advantage gained from an inverted wellbore is that it provides an improvement in gravel packing horizontal portions of the wellbore. The workstring (e.g. drill pipe) typically used for delivering the gravel slurry during a gravel packing operation can be seated into a shoe on the slotted liner at the tail of the wellbore whereby gravel can flow downward from the tail 20*c* and into the horizontal portion 20*b* of the well thereby taking advantage of gravity in the inverted portion to carry the gravel into the horizontal portion of the wellbore.

To summarize, the use of inverted production wells in a steamflood operation will increase and accelerate thermal communication between the injection and production wells while at the same time minimizing steam breakthrough at the production wells. Also, inverted production wells provide those traditional benefits which are normally derived from more conventional horizontal wells (e.g. long production intervals and reduced bottom water coning). Further, the cost of cyclic steam can be eliminated; the initial hot oil production response may be accelerated by as much as two years in a typical steamflood; heat utilization (both in the reservoir and along the wellbore) to increase oil production will be improved; and steam breakthrough will be reduced and delayed; all of which favorably affect the economics and performance of a steamflood operation by using inverted production wells.

What is claimed is:

1. A method for producing hydrocarbons from a subterranean reservoir, said method comprising:

injecting steam into said reservoir to heat said hydrocarbons; and producing said heated hydrocarbons through a production well having an inverted wellbore which extends into and terminating within said reservoir.

2. The method of claim 1 wherein said inverted wellbore comprises:

a substantially vertical non-inverted portion with angle building to near 90°, extending from the surface to approximately the top of said reservoir;

a substantially horizontal portion integral with said non-inverted portion and extending into said reservoir; and an upwardly curving tail portion which is integral with said substantially horizontal portion and extending upward towards the top of said reservoir.

3. The method of claim 2 wherein said tail portion of said inverted wellbore terminates near the top of said reservoir.

4. The method of claim 3 wherein said heated hydrocarbons are produced through a string of production tubing which is positioned within said wellbore and extends from the surface to a point substantially adjacent the lower end of said non-inverted portion of said wellbore.

5. The method of claim 4 including:

positioning a plugging element within said tail portion to block flow of steam from said tail portion into said horizontal portion of said horizontal wellbore.

6. The method of claim 4 including:

repositioning said plugging element within said tail portion of said wellbore during the life of said production well to compensate for increasing production of steam into said tail portion.

7. A method of producing hydrocarbons from a subterranean reservoir comprising:

completing an inverted production well into said reservoir, said production well being comprised of a substantially vertical, non-inverted portion with angle building to near 90° which extends from the surface to a depth substantially adjacent the top of said reservoir, a substantially horizontal portion integral with said non-inverted portion and extending into said reservoir; and an upwardly curving tail portion which is integral with said substantially horizontal portion and extending upward towards the top of said reservoir and terminating within;

injecting steam into said reservoir to heat said hydrocarbons; and producing said hydrocarbons through said inverted production well.

8. The method of claim 7 wherein said tail portion of said inverted wellbore terminates near the top of said reservoir.

9. The method of claim 8 wherein said steam is injected through an injection well which is spaced from said inverted production well.

10. The method of claim 8 wherein said steam is injected through said tail portion of said inverted production well.

11. The method of claim 10 wherein said hydrocarbons are produced to the surface through a string of production tubing which is positioned within said wellbore and extends from the surface to a depth substantially adjacent the lower end of said non-inverted portion of said wellbore.

12. The method of claim 10 including:

positioning a plugging element within said tail portion to block flow of steam from said tail portion into said horizontal portion of said wellbore.

13. The method of claim 12 including:

repositioning said plugging element within said tail portion of said wellbore during the life of said production well to compensate for increasing production of steam into said tail portion of said inverted wellbore.

14. A production well for producing hydrocarbons from a subterranean reservoir, said well having an inverted well bore comprising:

a substantially vertical, non-inverted portion with angle building to near 90° which extends from the surface to a depth substantially adjacent the top of said reservoir and terminating within;

a substantially horizontal portion integral with said non-inverted portion and extending into said reservoir; and an upwardly curving tail portion which is integral with said substantially horizontal portion and extending upward towards the top of said reservoir.

15. The production well of claim 14 wherein said inverted wellbore is cased substantially throughout said non-inverted portion.

16. The production well of claim 15 including:

a string of production tubing positioned within said wellbore and extending from the surface to at least a depth substantially adjacent the lower end of said non-inverted portion of said wellbore.

17. The production well of claim 16 including:

a plug positioned within said tail portion of said wellbore to block flow therein.

18. The production well of claim 17 including:

a string of injection tubing positioned within said wellbore and extending from the surface to a point within said tail portion of said wellbore.

* * * * *